US006971946B2

(12) United States Patent
Suzuki

(10) Patent No.: US 6,971,946 B2
(45) Date of Patent: Dec. 6, 2005

(54) MANUFACTURING METHOD OF ROLLER OF FILM OR TAPE HANDLING MACHINE

(75) Inventor: Tatsuo Suzuki, Inagi (JP)

(73) Assignee: Chiyoda Daiichikogyo Kabushikikaisha, Tokyo (JP)

( * ) Notice: Subject to any disclaimer, the term of this patent is extended or adjusted under 35 U.S.C. 154(b) by 0 days.

(21) Appl. No.: 10/931,966

(22) Filed: Sep. 2, 2004

(65) Prior Publication Data

US 2005/0050729 A1 Mar. 10, 2005

(30) Foreign Application Priority Data

Sep. 9, 2003 (JP) ..... 2003-316521

(51) Int. Cl.[7] ..... B24B 1/00; B23P 7/00; C25D 5/34

(52) U.S. Cl. ..... 451/49; 451/57; 451/58

(58) Field of Search ..... 451/41, 49, 57, 451/58

(56) References Cited

U.S. PATENT DOCUMENTS 1,952,655 A * 3/1934 Cecil ..... 451/140
3,451,112 A * 6/1969 Geiger et al. ..... 492/52
3,635,158 A * 1/1972 Budinger ..... 101/147
3,728,776 A * 4/1973 Defazio ..... 29/890.121
4,340,450 A * 7/1982 Saito ..... 205/136

* cited by examiner

*Primary Examiner*—Lee D. Wilson
*Assistant Examiner*—Anthony Ojini
(74) *Attorney, Agent, or Firm*—Jacobson Holman PLLC

(57) ABSTRACT

A lot of concave portions and convex portions are formed on a circumferential face of base metal cylinder or roller. Summits of the convex positions are ground and removed or erased. The base metal cylinder or roller is plated and coated to harden the circumferential face. The concave portions and the convex portions leave their shapes after the plating and coating process. Additionally, the plated and coated ends of the convex portions are ground in order to form flat faces or curved faces of ends, on which flat faces or curved faces a film web or tape web slides. The metal roller is used in a machine handling film or tape or any web material.

3 Claims, 9 Drawing Sheets

Prior Art

MANUFACTURING METHOD OF ROLLER OF FILM OR TAPE HANDLING MACHINE

BACKGROUND OF THE INVENTION

1. Field of the Invention

The present invention relates to a manufacturing method of rollers to be installed on machines for printing film such as photographic film, retorted food pouch sealing films and plastic films, or tape such as fabric tape, paper tape and rubber tape and the like wound on a winding cylinder, or for applying bond and, in particular, relates to a manufacturing method of rollers to be installed on film or tape handling machines for smoothly feeding or changing a feeding direction of film or tape, preventing any shear or shift in a printing of film or tape from happening, and attaining a stable feeding speed, when the rollers are used as feed rollers or guide rollers sliding on the film web and contacting with the film web.

2. Description of the Prior Art

Conventionally, the rollers to be installed on machines for printing film or tape wound around winding cylinders, or applying bond to the film or tape have been manufactured, as shown in FIG. 9, by applying a plating 23 on a circumference face of base material 22 of the roller 21 and finishing the circumstance face sliding on the film and tape so as to attain a mirror like condition having no unevenness on its circumstance face.

Because that the circumstance face of the roller 21 conventionally-made has a mirror-like condition, a contacting area between the circumstance face of the roller and the film or tape is large when the roller 21 is used as a feed roller or a guide roller on the machine handling film or tape. As a result, a frictional resistance between the roller 21 and film or tape becomes large, shifting the film or tape when the film or tape is fed or its feeding direction changes. It is impossible to attain smooth feeding of the file or tape, changing of a feeding direction of them, and constant speed feeding of film or tape, resulting in a precise printing and the like on the film or tape.

SUMMARY OF THE INVENTION

The problem to be solved with the invention is how to feed the film or tape or the like wound around the winding cylinder to the machine through a feeding roller or a guide roller at a constant speed without any shifting or out of its feeding position on the winding cylinder.

In order to solve the problem above, the inventor of the invention invented a manufacturing method of a roller by forming a lot of minute concave portions and convex portions on a circumferential surface of a base material consisting of cylindrical metal such as stainless steel and the like, grinding to remove summits of the convex portions of the concave portions and convex portions, and plating for rising a surface hardness with the thickness of plating determined so as to remain shapes of the concave portions and convex portions, forming a surface coating on the circumferential face of the roller, and grinding summits of convex portions of the plated concave-convex face in order to form minute flat or curved sliding faces of the convex portions.

The first object of the invention is to feed film or tape wound around a winding cylinder to a machine through a feeding roller or a guide roller without any shifting or out of position of the film or tape on the rollers and the winding cylinder.

The second object of the invention is to feed at a constant speed film or tape without shifting or out of position on the roller by making a lot of concave portions and convex portions on a circumferential outer face of the roller, as well as forming a flat or curved portions of the convex portions after the circumferential outer face is finally machined, in order to make a contacting area between the outer face and the film or tape and a frictional resistance, respectively small.

The above and other objects and novel characteristics of the invention will be apparent from a reading of the following description with reference to the accompanying drawings. The drawings must be used exclusively for understanding the invention and don't restrict the scope of the invention.

BRIEF DESCRIPTION OF THE DRAWINGS

FIG. 1 is a partly enlarged longitudinal and sectional view explaining a first step of the manufacturing method according to the invention for the roller installed on a machine handling film or tape and the like.

DETAILED EXPLANATION OF THE INVENTION

An embodiment of the manufacturing method of a roller installed on a film or tape handling machine will be explained in detail with reference to the accompanying drawings. The invention relates to a manufacturing method for the roller to be installed on a machine handling film or tape wound around a winding cylinder, such as printing machines and bag making machines. It is noted that the feed roller above-mentioned includes a press roller having the same function as that of the feed roller.

That is, the roller according to the invention is made of a base material of metal such as stainless steel and the like, a lot of-minute concave and convex portions are formed on an outer circumferential face of cylindrical metal such as stainless steel and the like, summits of the convex portions of the many minute concave-convex portions are ground and removed, a plating process and a coating process for hardening the outer face is applied to the base cylindrical metal at a depth leaving such profiles of concave portions and convex portions, and summits of the convex portions of the concave-convex portions plated and coated are ground forming flat or curved sliding face on the convex portions.

The invention relates to a manufacturing method of rollers for film or tape or the like by making the final machined face of the convex portions flat or curved sliding ones, lessening the contacting area between the final machined face and the film or tape or the like, and lessening the frictional resistance between the face and film or the like, making a feeding of film or tape or the like to the machine or a changing of its feeding direction able to do without any shifting or out of position of film or tape or the like on the metal cylinder or rollers and attaining a constant speed of feeding or moving of the film or the like.

Figure 1:
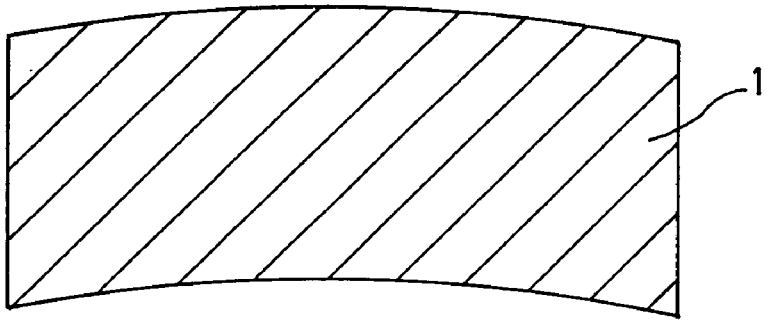

The first step of the manufacturing method of the roller according to the invention is a buff grinding step in which the surface of the base material 1 consisting of metal such as stainless steel and the like is ground by a buff so as to control the surface condition (see FIG. 1).

Figure 2:
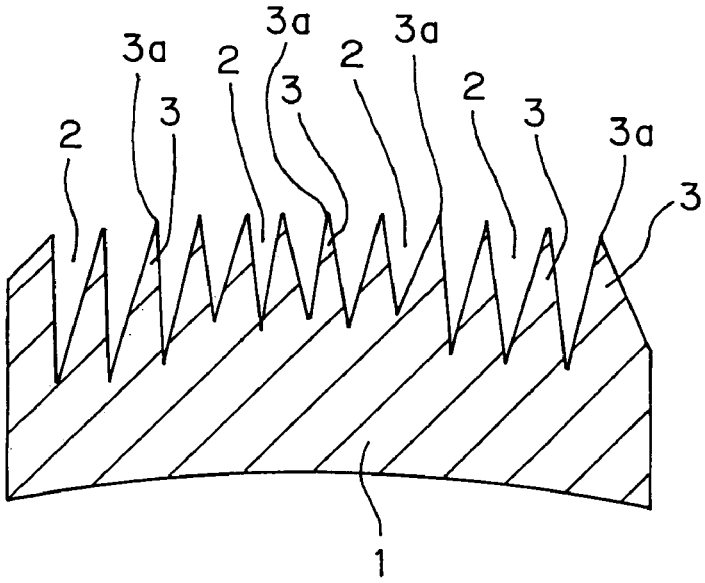
FIG. 2 is a partly enlarged longitudinal and sectional view explaining the second step of the manufacturing method according to the invention.

The second step of the manufacturing method of the roller according to the invention is a concave-convex face forming step in which a lot of minute concave portions 2 and convex portions 3 are formed on the surface of the base material 1 buff-ground in the first step by means of a physical means or chemical means (see FIG. 2).

The physical means used in the second step so as to form the concave portions 2 and convex portions 3 is, for example, a shot blasting process using whetstone striking the surface of the base material 1 with a predetermined pressure.

According to the shot blasting process, a shot blasting machine sprays sand grains onto the surface of the base material 1 forming a number of minute concave portions 2 and convex portions 3 on the surface of the base material 1. The sizes of the concave portions 2 and the convex portions 3 are predetermined according to characters of the film or tape to be transferred along the concave-convex portions. It is not necessary particularly to restrict the sizes and preferably in general the sand blasting process employing grain sizes of No. 10–2000 is used so as to form the concave portions 2 and the convex portions 3 of sizes less than 10 micrometer.

In addition, the manufacturing method of the invention can employ dry type shot blasting process and wet type shot blasting process.

According to other physical means to be used in the machining step for forming a lot of minute concave portions 2 and convex portions 3 on the base material 1, there are machine grinding means using a grinder whetstone, a machine cutting means using cutting tool such as bites, and an eletrolysis grinding means using electric discharge phenomenon. All grinding means above can be used in the manufacturing method according to the invention.

The chemical means for forming a lot of minute concave portions 2 and convex portions 3 on the base material 1 are a chemical etching process forming these concave portions 2 and convex portions 3 by etching the base material with chemical agent, a wet plating, and a micro-porous plating, these chemical means can be employed to the manufacturing method according to the invention.

Figure 3:
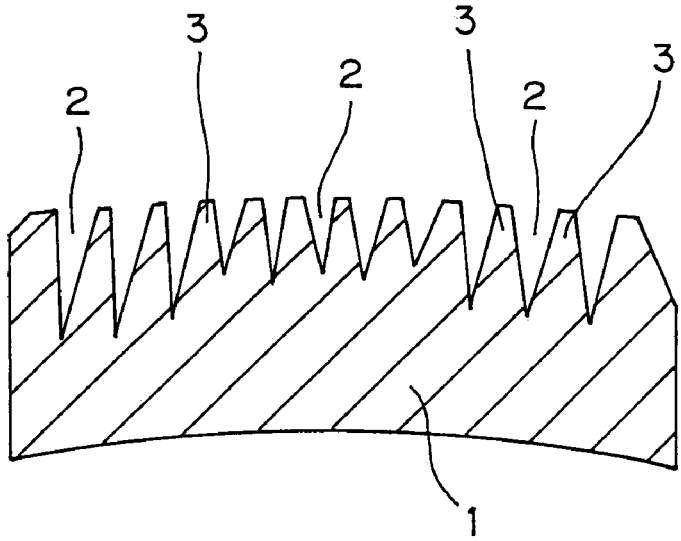
FIG. 3 is a partly enlarged longitudinal and sectional view explaining the third step of the manufacturing method.

The third step of the manufacturing method is a grinding one grinding and removing the summits 3*a* of many convex portions 3 formed on the base material 1 in the second step (see FIG. 3).

Figure 4:
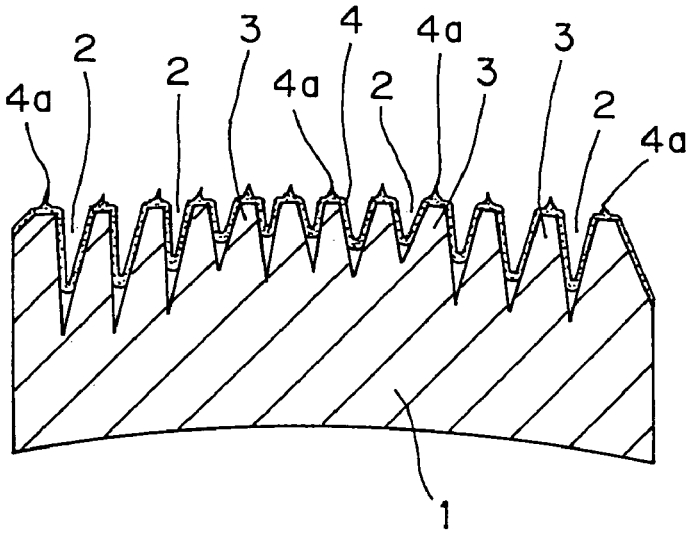
FIG. 4 is a partly enlarged longitudinal and sectional view explaining the forth step of the manufacturing method.

The fourth step 4 of the invention consists of an applying of plating and coating on the surface of base material 1 after the tops or summits 3*a* of convex portions 3 are ground and removed in the third step, as shown in FIG. 4, so as to leave the shapes or profiles of the concave portions 2 and convex portions 3 and additionally form a surface coating 4 thereon.

As a result, a hardness of the surface of the roller rises. The plating operation mentioned above is preferably hard type chrome plating.

Figure 5:
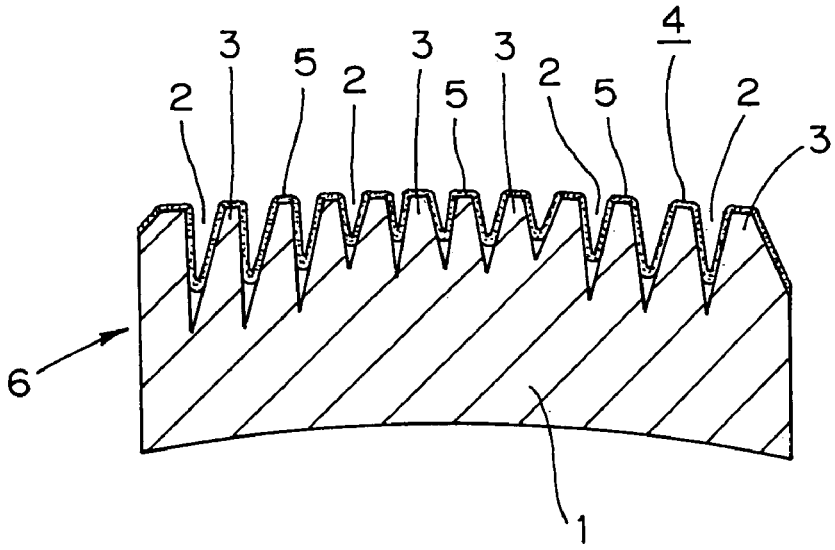
FIG. 5 is a partly enlarged longitudinal and sectional view explaining the fifth step of the manufacturing method.
Figure 6:
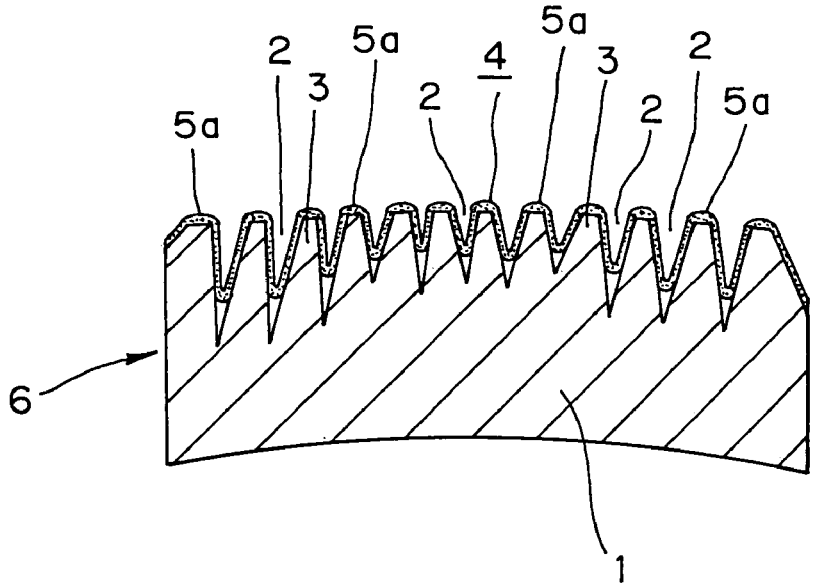
FIG. 6 is a partly enlarged longitudinal and sectional view explaining another fifth step of the manufacturing method.

According to the fifth step of the roller manufacturing method, tops 4*a* of the convex portions 3 of the concave-convex portions 2 and 3 formed on the surface coating 4 processed in the plating step of the fourth step are ground by means of thread buff and whetstone. The fifth step is a surface grinding and finishing one, in which the convex portions 3 formed on surface of the roller 6 are machined to form flat type sliding faces 5 (see FIG. 5). It is noted that instead of the flat type sliding faces 5, curved shape sliding faces 5*a* (see FIG. 6) are formed on the convex portions 3.

Figure 7:
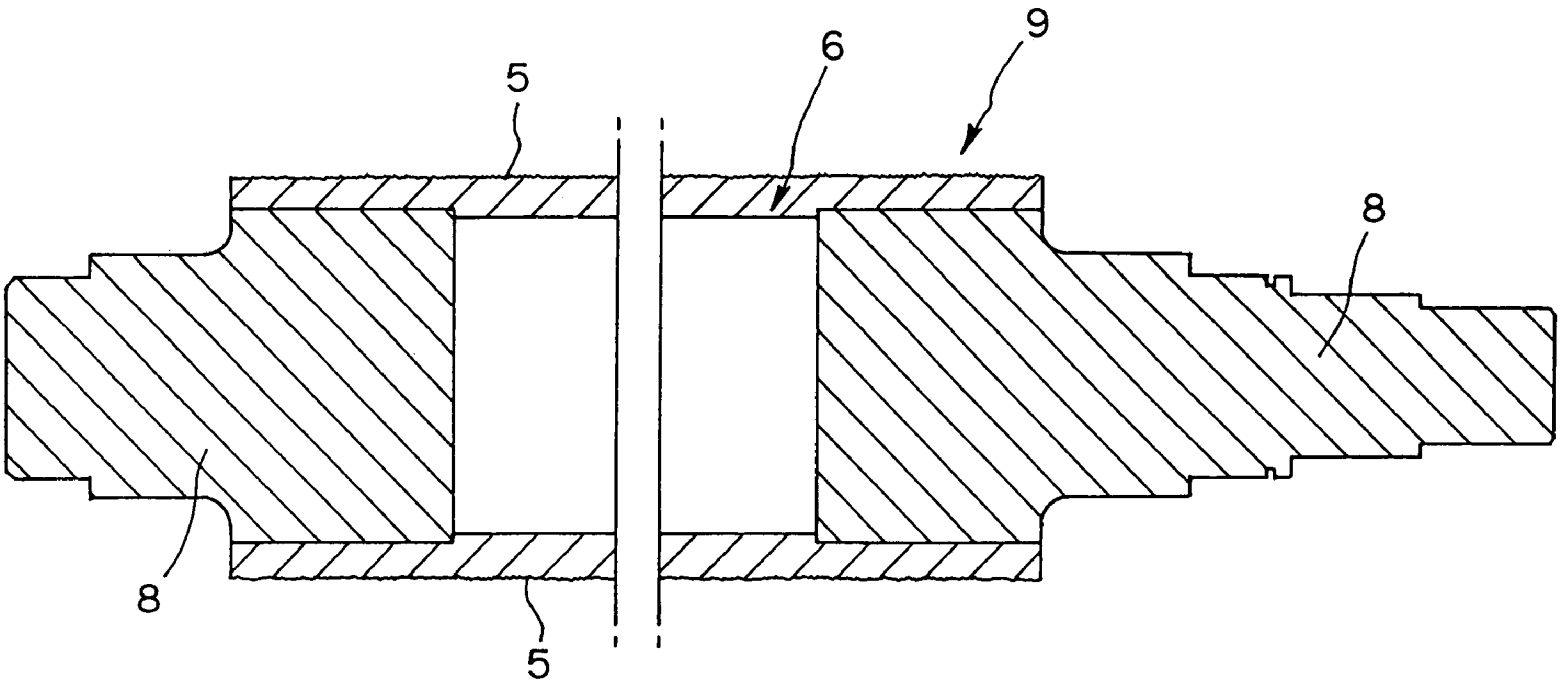
FIG. 7 is a sectional view of the roller machine employing the roller manufactured by the method of the invention.

As shown in FIG. 7, bosses 8 for revolving the roller 6 are inserted and fixed at both ends of the roller 6 after the manufacturing steps above are carried out, and the roller machine 9 is obtained.

Figure 8:
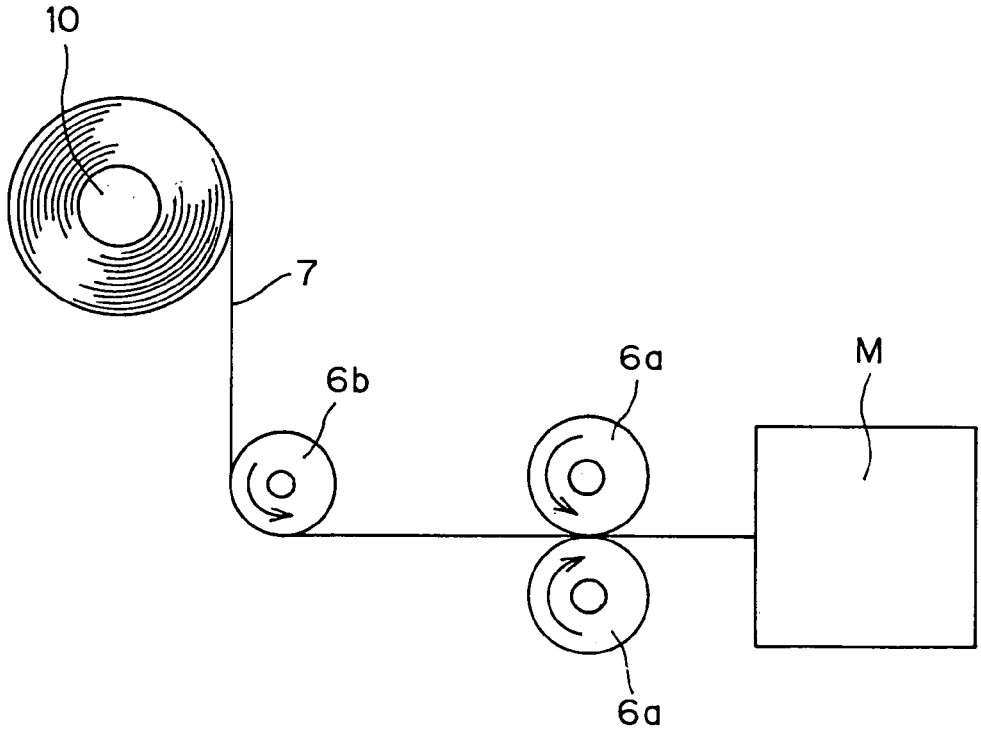
FIG. 8 is an outlined explanation view of the machine provided with a roller manufactured by the manufacturing method of the invention.
Figure 9:
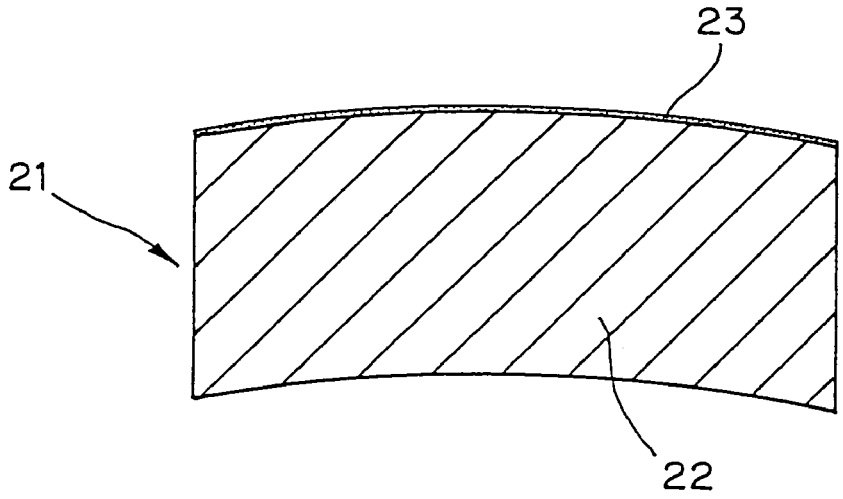
FIG. 9 is a partly enlarged longitudinal and sectional view of the conventional roller.

As shown in FIG. 8, the roller machine 9 is used as a feed roller 6*a* and a guide roller 6*b* installed between a machine M, for example, of a printer and a winding cylinder 10 on which film or tape 7 or the like is wound.

When the rollers of the invention are used as a feed roller 6*a* and a guide roller 6*b* of the machine M, because that a lot of minute concave portions 2 and convex portions 3 are continuously formed on the base material 1 of the roller, surfaces of the concave portions 2 and convex portions 3 are plated and coated, and surfaces of tops of the convex portions 3 are flatly finished obtaining the sliding face 5 (see FIG. 5), or surfaces of tops of the convex portions 3 are curved in a shape of the sliding face 5*a* (see FIG. 6), a film or tape 7 contacts only the small area of the sliding faces 5, 5*a*, comparing to that of the conventional mirror like contact, resulting in a small frictional resistance between the film or tape 7 or the sliding faces 5, 5*a*.

Additionally, the air within the concave portions 2 functions as a cushion and the film or tape 7 fails to enter into the concave portions 2, resulting in the good slidability and good separatability between the film or tape 7 and the roller surface. The film or tape 7 is fed and changes its feeding direction smoothly when the film web slides on the sliding faces 5, 5*a* of the roller 6, resulting in no shift of the film or tape 7 along the surface of the roller 6 or winding cylinder and a constant speed transferring of the film or tape or the like.

In addition, when the roller 6 is used after it is manufactured by these five steps, it is possible to feed and change smoothly the transferring direction of the film or tape or the like 7 without scratching of the film or tape or the like 7.

When it is no problem even that very small scratches are formed on the soft material product such as fabric tape and rubber tape fed by the roller, it is possible to use the roller manufactured by the steps of 1 to 4 and the surface coating 4 of the bade material 1 as a sliding face of the roller.

That is, when the surface of the roller 6 is manufactured in the step 3 grinding and removing the summits of the convex portions 3 of the base material 1 so as to leave the concave portions 2 and the convex portions 3 on the surface of the roller after it is plated and coated and form the hard surface coating 4, it is possible to attain sufficient function of sliding surface of the roller 6.

As described above, the manufacturing method of the roller of the invention has characteristics, so the invention has the effect detailed below.

When the roller manufactured in accordance with the invention is used as a feed roller or a guide roller of the machine handling film webs and the like, a contacting area between the film web and the sliding face of the convex portions formed on the surface of the roller becomes very small end as a result a frictional resistance between them lessen. So, the film web sliding along the surface of the roller and contacting with the convex portions on the surface fails to shift or move out of position on the roller smoothly at a constant speed. As a result, the film web or the like is machined precisely, so that the machining work can be done effectively.

What is claimed is:

1. A manufacturing method of a rollers and guides for transporting films, consisting of a first step for buff-grinding a surface of base material of a metal roller, a second step for forming a plurality of minute concave portions and convex portions on the surface of base material, a third step for grinding and removing summits of the convex portions of the plurality of minute concave portions and convex portions respectively formed by the second step, a fourth step for plating and coating the base material of roller so as to retain the shapes of the concave portions and convex portions, and a fifth step for grinding ends of the convex portions of the concave portions and convex portions plated and coated by the fourth step and forming flat or curved sliding surfaces located on the ends of the convex portions.

2. A manufacturing method of a roller and guides for transporting films, consisting of a first step for buff grinding a surface of base material of a metal roller, a second step for forming a plurality of minute concave portions and convex portions on the surface of base material, a third step for grinding and removing summits of the convex portions of the plurality of minute concave portions and convex portions respectively formed by the second step, and a fourth step for plating and coating the base material of roller so as to retain the shapes of the concave portions and convex portions.

3. The manufacturing method of rollers and guides for transporting films according to claim 1, wherein, in the second step, the plurality of minute concave portions and convex portions are formed on the surface of the base material of metal roller by means of anyone of the methods consisting of shot blasting, a machine grinding, a machine cutting, electrolysis grinding, a chemical grinding, a wet plating, and a micro-porous plating.

* * * * *